United States Patent [19]

Moore

[11] Patent Number: 4,660,541

[45] Date of Patent: Apr. 28, 1987

[54] WATER HEATER WITH SUBMERGED COMBUSTION CHAMBER

[75] Inventor: Henry J. Moore, Los Angeles, Calif.

[73] Assignee: Mor-Flo Industries, Inc., Cleveland, Ohio

[21] Appl. No.: 904,795

[22] Filed: Sep. 5, 1986

Related U.S. Application Data

[63] Continuation of Ser. No. 711,734, Mar. 14, 1985, abandoned.

[51] Int. Cl.[4] ..... F24H 1/20

[52] U.S. Cl. ..... 126/360 R; 122/17; 122/361

[58] Field of Search ..... 126/361, 362, 360 R, 126/350 R; 122/17, 48, 121, 182 R, 182 T, 13 R, 16; 431/171, 172, 8, 9

[56] References Cited

U.S. PATENT DOCUMENTS

| | | | |
|---|---|---|---|
| 1,671,972 | 6/1928 | Delling | 122/182 R |
| 1,701,835 | 2/1929 | Cannon . | |
| 1,790,454 | 1/1931 | Arrowsmith . | |
| 1,795,832 | 3/1931 | Cannon . | |
| 1,948,064 | 2/1934 | Cartter | 122/17 |
| 1,961,231 | 6/1934 | Maier | 122/17 |
| 2,329,271 | 9/1943 | Jorolemon | 126/350 R |
| 2,329,272 | 9/1943 | Jorolemon | 126/350 R |
| 2,728,325 | 12/1955 | Sturma | 126/360 R |
| 2,729,200 | 1/1956 | Miller | 122/140 |
| 2,737,175 | 3/1956 | Dunston | 126/360 |
| 2,790,428 | 4/1957 | Buttler | 122/17 |
| 2,888,911 | 6/1959 | Thompson | 122/156 |
| 2,951,477 | 9/1960 | Harper | 126/360 R |
| 3,028,843 | 4/1962 | Carlson | 122/149 |
| 3,131,749 | 5/1964 | Davis, Sr. | 158/4 |
| 3,180,322 | 4/1965 | Gibbard | 122/17 |
| 3,349,754 | 10/1967 | Bock | 122/17 |
| 3,527,260 | 9/1970 | Kimmel | 122/136 |
| 3,802,397 | 4/1974 | Wariner | 122/136 |
| 4,257,355 | 3/1981 | Cook | 122/17 |
| 4,301,772 | 11/1981 | Eising | 122/17 |
| 4,328,791 | 5/1982 | Moore, Jr. | 126/427 |
| 4,397,296 | 8/1983 | Moore, Jr. | 126/360 |
| 4,465,024 | 8/1984 | Adams | 122/17 |

FOREIGN PATENT DOCUMENTS

| | | |
|---|---|---|
| 486936 | 11/1929 | Fed. Rep. of Germany . |
| 2829039 | 10/1978 | Fed. Rep. of Germany . |
| 714242 | 11/1931 | France . |

*Primary Examiner*—Larry Jones
*Assistant Examiner*—Noah Kamen
*Attorney, Agent, or Firm*—Body, Vickers & Daniels

[57] ABSTRACT

An improved water heater has a submerged combustion chamber providing increased efficiency, lowered production of oxides of nitrogen and ease of manufacture. The water heater has a horizontal cylindrical combustion chamber and a flue tube having a closed bottom penetrating through a major portion of the combustion chamber along a diameter of the combustion chamber causing turbulent combustion.

3 Claims, 3 Drawing Figures

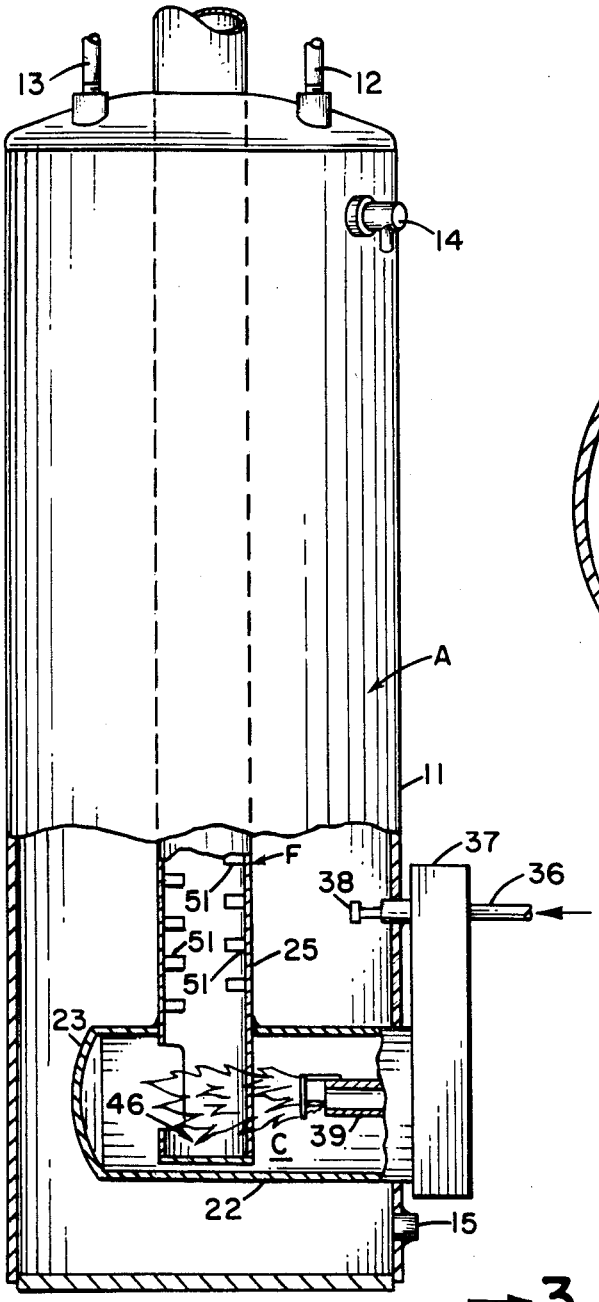
FIG. 1
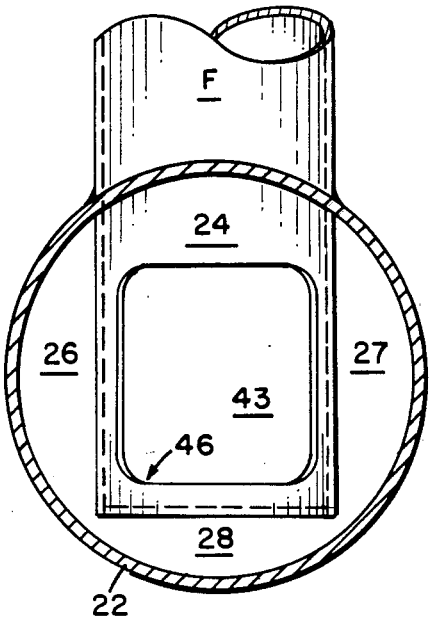
FIG. 3
FIG. 2
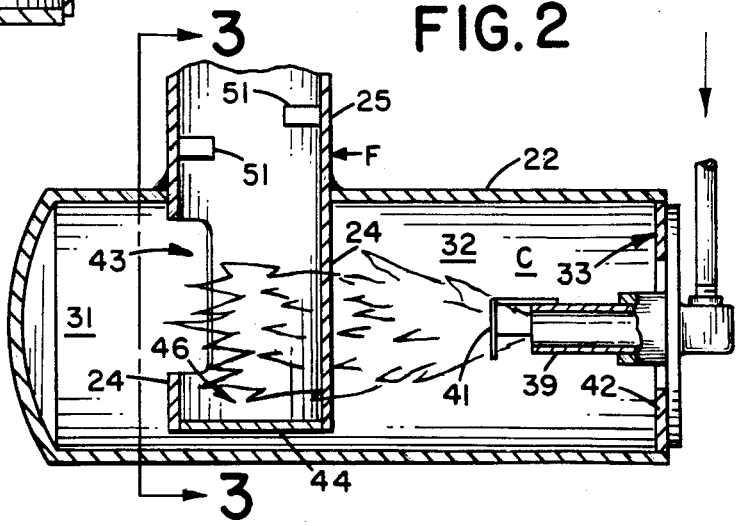

WATER HEATER WITH SUBMERGED COMBUSTION CHAMBER

This is a continuation of Ser. No. 711,734 filed Mar. 14, 1985, now abandoned.

FIELD OF THE INVENTION

This invention relates generally to the art of water heaters and more particularly to an improved residential gas operated water heater.

BACKGROUND OF THE INVENTION

Water heating in residential and commercial establishments has been carried out for many years by providing a burner below a tank of water controlled by a thermostat. In the past, the efficiency of such domestic water heaters was of little concern as natural gas and bottled gas used as an energy source were relatively inexpensive.

The content of the exhaust gases of such water heaters was also of little concern. The gas burned was considered a clean fuel and each installation was so small that products of combustion introduced into the atmosphere by such units were ignored.

The efficiency of all gas consuming appliances has now become more of a concern to both government units and the public at large. Also, the products of combustion of gas have come under government scrutiny, and in some jurisdictions, the amount of certain gases produced by domestic gas water heaters is now the subject of regulation.

Oxides of nitrogen generated by the combustion of fuels are currently the subject of governmental interest and regulation. Oxides of nitrogen are believed to react in the atmosphere to form ozone. Oxides of nitrogen are also believed to react with hydrocarbon pollutants in a complex manner to form chemicals which irritate the eyes and nose and may be harmful. Because of this, emissions of oxides of nitrogen from many sources including water heaters are regulated in the Los Angeles area. Regulation of emission of oxides of nitrogen is becoming more widespread.

Attempts have been made in the past to address the efficiency issue in domestic gas water heaters. U.S. Pat. No. 4,397,296 to Moore, et al., describes a water heater using a combustion chamber surrounded by a body of water to be heated. Such an arrangement minimizes heat loss to the atmosphere from the combustion chamber thereby improving efficiency. While this structure improves efficiency, it increases the cost of manufacturing the water heater because of the complex construction involved.

U.S. Pat. No. 4,301,772 to Eising also proposes to increase efficiency by disposing a combustion chamber within the body of water to be heated. This structure uses a cylindrical combustion chamber inclined with respect to horizontal. Means are provided to deal with water condensed from the products of combustion which gather in this inclined combustion chamber and flow toward the burner opening.

Neither of these patents discusses the reduction of oxides of nitrogen in the products of combustion.

SUMMARY OF THE INVENTION

The present invention contemplates a new and improved water heating apparatus having a high efficiency combustion chamber which reduces production of oxides of nitrogen.

In accordance with the present invention, there is provided a water heating apparatus comprised of a tank adapted to hold a body of water, a combustion chamber within said tank, a barrier obstructing a major portion of the cross-sectional area of the combustion chamber dividing the combustion chamber into a vent portion and a burner portion, a flue tube passing through the tank and communicating with the vent portion of the combustion chamber, and a burner in the combustion chamber burner portion. The barrier in this position causes turbulence in the flame and hot gas flow resulting in an improved heat transfer to the wall of the chamber.

Further in accordance with the invention, the flue tube extends into the combustion chamber to form the barrier dividing the combustion chamber into a burner portion and a vent portion, the flue tube having an opening admitting gases from the vent portion of the combustion chamber only. The gases must then flow around the flue tube before being exhausted.

Further in accordance with the invention, the bottom of the flue tube is closed and the flue opening is disposed a distance above the bottom whereby the flue tube vertical wall surrounds the closed bottom forming a cup-like receptacle at the flue bottom. Such a receptacle collects the water vapor of combustion as it condenses, cooling the gases of combustion and ultimately enabling it to be boiled away.

It is the principal object of the invention to provide a high efficiency gas water heater producing a low level of oxides of nitrogen in its exhaust.

It is a further object of the present invention to provide a high efficiency gas water heater which is inexpensive to manufacture.

It is yet another object of the present invention to provide a high efficiency gas water heater not requiring auxiliary means to dispose of condensate produced in the combustion process.

The invention may take physical form in certain parts and arrangements of parts, a preferred embodiment of which will be described in detail in this specification and illustrated in the accompanying drawings which form a part hereof.

BRIEF DESCRIPTION OF THE DRAWINGS

FIG. 1 is a side elevation of a water heater illustrating a preferred embodiment of the present invention with a portion of the water heater cut away and the insulation removed;

FIG. 2 is an enlarged fragmentary view of the combustion chamber; and,

FIG. 3 is a section taken along line 3—3 of FIG. 2 showing the combustion chamber looking from the closed end.

DESCRIPTION OF THE PREFERRED EMBODIMENT

Referring now to the drawings, wherein the showings are for the purposes of illustrating a preferred embodiment of the invention only and not for the purposes of limiting same, the FIGS. show a conventional water containing tank A having a water inlet 12, a water outlet 13, a pressure relief valve 14 and a drain 15, all in conventional configuration, a combustion chamber C in the lower portion of the tank, and a flue tube F extending vertically from inside the chamber C to and out of the top of the tank A.

Tank A forms no part of the present invention and may take any one of a number of different shapes. In the embodiment shown, it comprises a steel cylinder 11 closed at both ends and having a vertical axis. In the completed state, the tank also has a layer of insulation completely surrounding it and a metal envelope protecting this insulation in a conventional manner. Neither of these elements is shown in the drawings for the purposes of clarity.

The combustion chamber C is generally in the form of a steel tube 22 horizontally disposed within and along a diameter of tank A close to but spaced from the bottom thereof. Tube 22 is preferably of a length to extend substantially across the tank with its inner end closed by a domed closure plate 23 welded thereto.

While the individual exact measurements may vary, in the preferred embodiment, tube 22 is approximately $14\frac{3}{4}''$ long for a 16" diameter, 40 gallon nominal capacity water heater and a $16\frac{3}{4}''$ long for an 18" diameter, 50 gallon nominal capacity water heater. As shown, tube 22 extends $5\frac{1}{2}''$ beyond the central axis of tank A in a 40 gallon water heater and $6\frac{1}{2}''$ beyond the central axis of tank A in a 50 gallon heater. Tube 22 also extends $1\frac{1}{4}''$ out to the side of tank A where it ends in a circular access opening 33.

Flue tube F is in the form of an elongated four inch diameter tube 25 which passes vertically through tank A along its central axis from a point above the top to a point substantially inside of and in the middle of combustion chamber C where it creates a barrier dividing the combustion chamber C into a vent portion 31 and an burner portion 32. Flue tube 25 also has on the inside along its length a conventional baffle 51 which causes turbulence in the hot gases flowing up the flue tube and also helps to conduct heat from these hot gases to the inner walls of the flue tube and thus to the water in tank A.

Vent portion 31 of the combustion chamber is bounded by the lower portion 24 of flue tube 25 and closure plate 23. Burner portion 32 is bounded by the lower portion 24 of flue tube 25 and combustion chamber access opening 33. Lateral open areas 26, 27 and bottom open area 28 around the sides and bottom of the lower portion 24 of flue tube 25 remain available for the passage of gases. However, at its widest point, the lower portion 24 of flue tube 25 occupies more than one-half of the cross-sectional area of combustion chamber C. The lower portion 24 of flue tube 25 is closed by plate 44 and has an inlet opening 43, importantly, facing the vent portion 31 of chamber C. Also importantly, the lower edge of opening 43 is spaced above plate 44 to form a cup 46 which catches and holds any water condensing in the flue tube 25 as the hot gases pass therethrough.

Opening 43 may take a number of shapes and dimensions but is preferably square with its width dimension preferably selected to be one-third the circumference of flue 25. In the embodiment shown, opening 43 is three and one-half inches high, approximately four and one-fifth inches wide and has rounded corners.

Pipe 36 provides gas to a conventional thermostatic control 37 using a conventional water temperature sensing element 38 to control gas flow to burner 39.

Burner 39 is an in-shot type burner located in the open portion 32 of combustion chamber C. Burner 39 projects a large flame into the burner portion of combustion chamber C which is shaped by deflection plate 41 to bathe the walls of combustion chamber C, heating the combustion chamber and the water surrounding it. Such burners are commerically available from sources such as White Rogers and Jade Controls.

Access opening 33 is conventionally closed by sheet metal closure 42 and insulated in the conventional manner.

The flame from burner 39 is obstructed by the lower portion 24 of flue tube 25 and passes there around through lateral open areas 26, 27 and bottom open area 28 into the vent portion 31 of combustion chamber. The flame thus flows through passages having the large cross-sectional area of the burner portion 32, then through a space having a restricted cross-sectional area around flue tube 25 and into the space having a large cross-sectional area of the vent portion 31. The products of combustion enter flue tube 25 through rectangular flue opening 43 communicating with combustion chamber vent portion 31 and are exhausted through flue tube 25.

The flow of the flame produced by burner 39 through the obstructed combustion chamber C causes turbulent combustion. This turbulent combustion is believed to reduce production of oxides of nitrogen.

This turbulence also causes the gases of combustion to repeatedly contact the walls of chamber C which results in good heat transfer to the water while at the same time helping to limit the maximum temperature of the gases.

As the products of combustion go up flue tube 25, heat is extracted from them by the relatively cool surfaces of the flue tube wall and baffle 51 and transferred to the water in tank A. Water vapor contained in the products of combustion condenses on these surfaces, transferring the latent heat of vaporization to them and thus to the water in tank A. The condensed water flows down flue tube 25 into receptable 46. The water cools the lower portion 24 of flue tube 25 and is evaporated by the heat of combustion.

It is believed that the lower portion 24 of flue tube 25 projecting into the combustion chamber C reduces formation of oxides of nitrogen through a number of mechanisms. As previously discussed, the obstruction formed by the lower portion 24 of flue tube 25 induces turbulence in the combustion pattern. This turbulence is believed to reduce formation of oxides of nitrogen directly.

In addition to the direct effects of this turbulence, the turbulence provides more contact of the combustion gases with the walls of the combustion chamber, cooling the flame and the products of combustion. A lower combustion temperature reduces production of oxides of nitrogen.

Also, the condensed water collecting in the cup-like receptacle 46 cools the surface of the lower portion 24 of flue tube 25 in chamber C presenting additional cooled surfaces in the combustion chamber C thereby further lowering combustion temperatures and reducing production of oxides of nitrogen.

The invention has been described with reference to a preferred embodiment. Obviously, modifications and alterations will occur to others upon reading and understanding of this specification. It is intended to include all such modifications and alterations insofar as they come within the scope of the appended claims or the equivalents thereof.

Having thus described the invention I claim:

1. A fluid heater comprising:

(a) an elongated combustion chamber having a generally uniform cross section over its length and being horizontally disposed; (b) a vertical flue tube extending downwardly into said combustion chamber wherein a bottom of said flue tube is closely spaced from a bottom of said chamber to thereby divide said chamber into first and second portions, said flue having a closed bottom; (c) a flue opening in said flue tube located in a side of said flue tube facing said first portion and disposed a given distance above said closed bottom so as to retain exhaust condensate for evaporation; and (d) a burner disposed in said combustion chamber second portion projecting a flame to impinge upon said flue tube to reduce the formation of oxides of nitrogen of combustion.

2. The fluid heater of claim 1 wherein said fluid in water contained in a tank and said combustion chamber is disposed within said tank.

3. The fluid heater of claim 1 wherein said combustion chamber has a circular cross section, said flue tube has a circular cross section, said flue tube has a diameter approximately equal to two-thirds of the diameter of said combustion chamber, and said flue tube penetrates along a diameter of said combustion chamber occupying three-forths of said combustion chamber diameter.

* * * * *